US007039212B2

(12) United States Patent
Poling et al.

(10) Patent No.: US 7,039,212 B2
(45) Date of Patent: May 2, 2006

(54) WEATHER RESISTANT PORTING

(75) Inventors: John B. Poling, Sparks, MD (US); Bradley M. Starobin, Baltimore, MD (US); Allen S. Baran, Baltimore, MD (US); Matthew S. Polk, Jr., Baltimore, MD (US)

(73) Assignee: Britannia Investment Corporation, San Diego, CA (US)

( * ) Notice: Subject to any disclaimer, the term of this patent is extended or adjusted under 35 U.S.C. 154(b) by 5 days.

(21) Appl. No.: 10/660,727

(22) Filed: Sep. 12, 2003

(65) Prior Publication Data

US 2005/0058315 A1 Mar. 17, 2005

(51) Int. Cl.
*H04R 25/00* (2006.01)

(52) U.S. Cl. ..... 381/349; 381/345; 381/348; 381/397; 381/341; 381/338; 181/149

(58) Field of Classification Search ..... 381/337, 381/343, 349, 350, 357, 358, 345, 339, 163, 381/186, 335, 351; 181/156, 199, 160, 144, 181/145, 148, 150, 154, 163, 182, 184, 196
See application file for complete search history.

(56) References Cited

U.S. PATENT DOCUMENTS

| | | | | |
|---|---|---|---|---|
| 4,210,778 | A * | 7/1980 | Sakurai et al. | 381/349 |
| 4,997,057 | A * | 3/1991 | Furukawa | 381/96 |
| 5,517,573 | A | 5/1996 | Polk et al. | |
| 5,629,502 | A * | 5/1997 | Nakano | 181/156 |
| 5,809,154 | A | 9/1998 | Polk | |
| 6,079,515 | A * | 6/2000 | Newman | 181/156 |

* cited by examiner

*Primary Examiner*—Suhan Ni
*Assistant Examiner*—Dionne Harvey
(74) *Attorney, Agent, or Firm*—Sterne, Kessler, Goldstein & Fox P.L.L.C.

(57) ABSTRACT

A port for a loudspeaker is disclosed which is sufficiently weather resistant for long term outdoor use and which prevents debris, insects and other vermin from entering the loudspeaker and which is compact and efficient.

9 Claims, 10 Drawing Sheets

Fig. 1 - Prior Art

Fig. 2, Prior Art

WEATHER RESISTANT PORTING

BACKGROUND OF THE INVENTION

1. Field of the Invention

The present invention relates generally to the field of loudspeaker design and specifically to the design of more efficient loudspeakers for long-term outdoor use.

2. Background of the Invention

As loudspeakers designed for outdoor use have become more popular the demand for improved performance for this application has also increased. A particular problem for loudspeakers used outdoors is reproduction of adequate quantity and quality of low frequency sounds. For indoor applications, the enclosed nature of the room where the loudspeaker is located contributes to increased low frequency response and efficiency, known as "room gain". In contrast, outdoor applications do not have the benefit of any such "room gain" at low frequencies and are, therefore, disadvantaged in regard to both low frequency response and efficiency. Furthermore, for indoor applications, one of the most common techniques to obtain greater low frequency efficiency is the use of a ported enclosure. Those skilled in the art will confirm that that the use of a port or vent, sometimes also referred to as a duct, in a loudspeaker enclosure can produce significant gains in efficiency at low frequencies as compared to a sealed enclosure. However, this technique is rarely used in loudspeakers designed for long-term outdoor use due to the need for weather resistance in a variety of orientations and the need to keep debris, insects and other vermin from entering the loudspeaker enclosure. Occasionally, ports are used in outdoor loudspeakers with a screen or mesh covering the port opening. However, while effective in preventing debris and insects from entering the enclosure, this approach does little to keep out water and substantially diminishes performance due to the turbulence and loss generated by the screen. In general, loudspeakers designed for long-term outdoor use employ sealed enclosures which typically offer lower efficiency at low frequencies and further reduce the ability of such outdoor loudspeakers to reproduce adequate quantity and quality of low frequency sounds.

Therefore, needed in the art is a porting structure which is sufficiently resistant to intrusion by water, debris, insects and other vermin so as to be acceptable for most outdoor applications regardless of the orientation of the loudspeaker system and the port structure while still being compact, efficient and reducing turbulence and loss.

SUMMARY OF THE INVENTION

Accordingly, provided herein is loudspeaker system having an enclosure having at least one port or duct for tuning the low frequency performance of said loudspeaker system, the port extending at least in part outside of the enclosure. Further, the port has a predetermined internal cross-sectional area, a first external cross-sectional area, near the outermost end of said duct and a second external cross-sectional area between the first external cross-sectional area and the enclosure such that the first external cross-sectional area is larger than the second external cross-sectional area. The port also includes a port cover for covering the outermost opening of said port, wherein the port cover is more or less cup-shaped so as to fit over and overlap the outermost end of the port. Further, the port cover is dimensioned and supported such that a minimum distance is maintained between the internal surface of the port cover and the exterior of the port approximately equal to one-half of the radius of a circle having an area equal to the predetermined internal cross-sectional area of the port. The port cover is also dimensioned and supported such that the minimum distance between the nearest edge of the port cover and the wall of the enclosure averages no less than the minimum distance around the perimeter of the port cover such that the total cross-sectional area of the opening created between the port cover and the enclosure is substantially greater than the predetermined internal cross-sectional area of the port. Finally, the system is arranged such that any line drawn directly from a tangent point on the outer most end of the port through a tangent point on the edge of the port cover nearest the enclosure intersects with some solid part of the loudspeaker system.

BRIEF DESCRIPTION OF THE DRAWINGS/FIGURES

Figure 3:
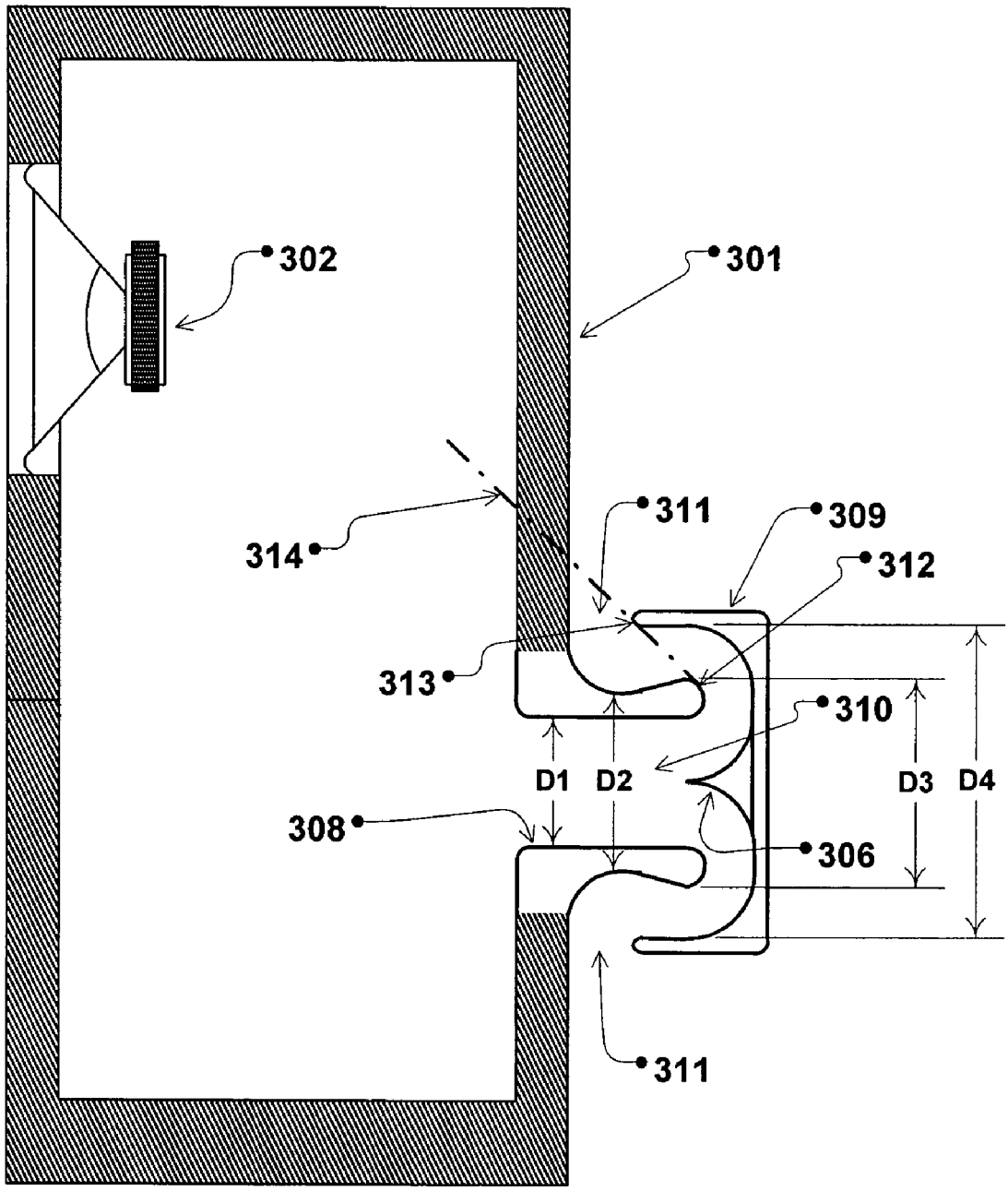
FIG. 3 illustrates a cross-sectional side view of a loudspeaker having a weather resistant port according to the present invention.
Figure 3A:
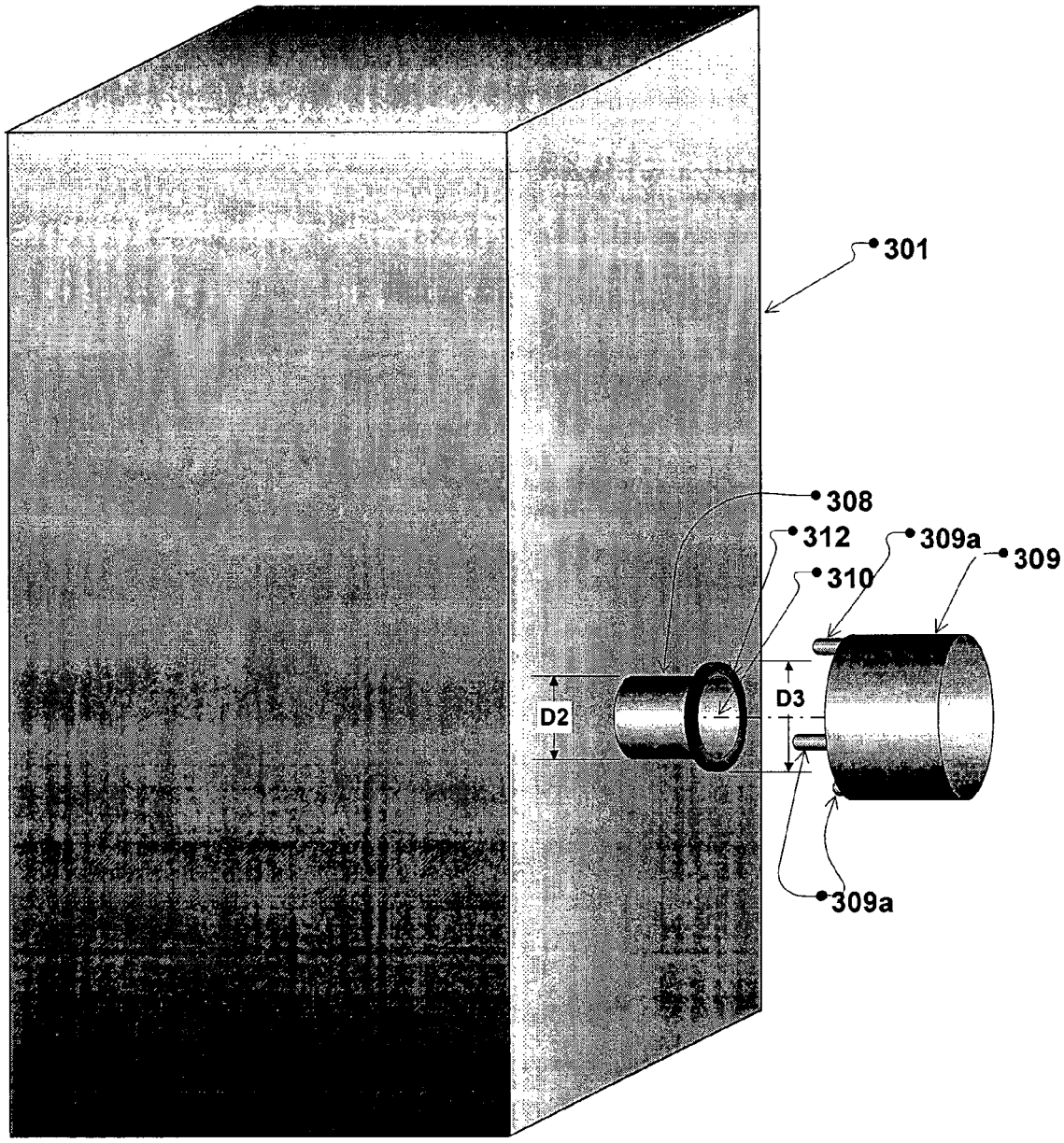

FIG. 3*a* illustrates a perspective, exploded view of the loudspeaker of FIG. 3.

Figure 3B:
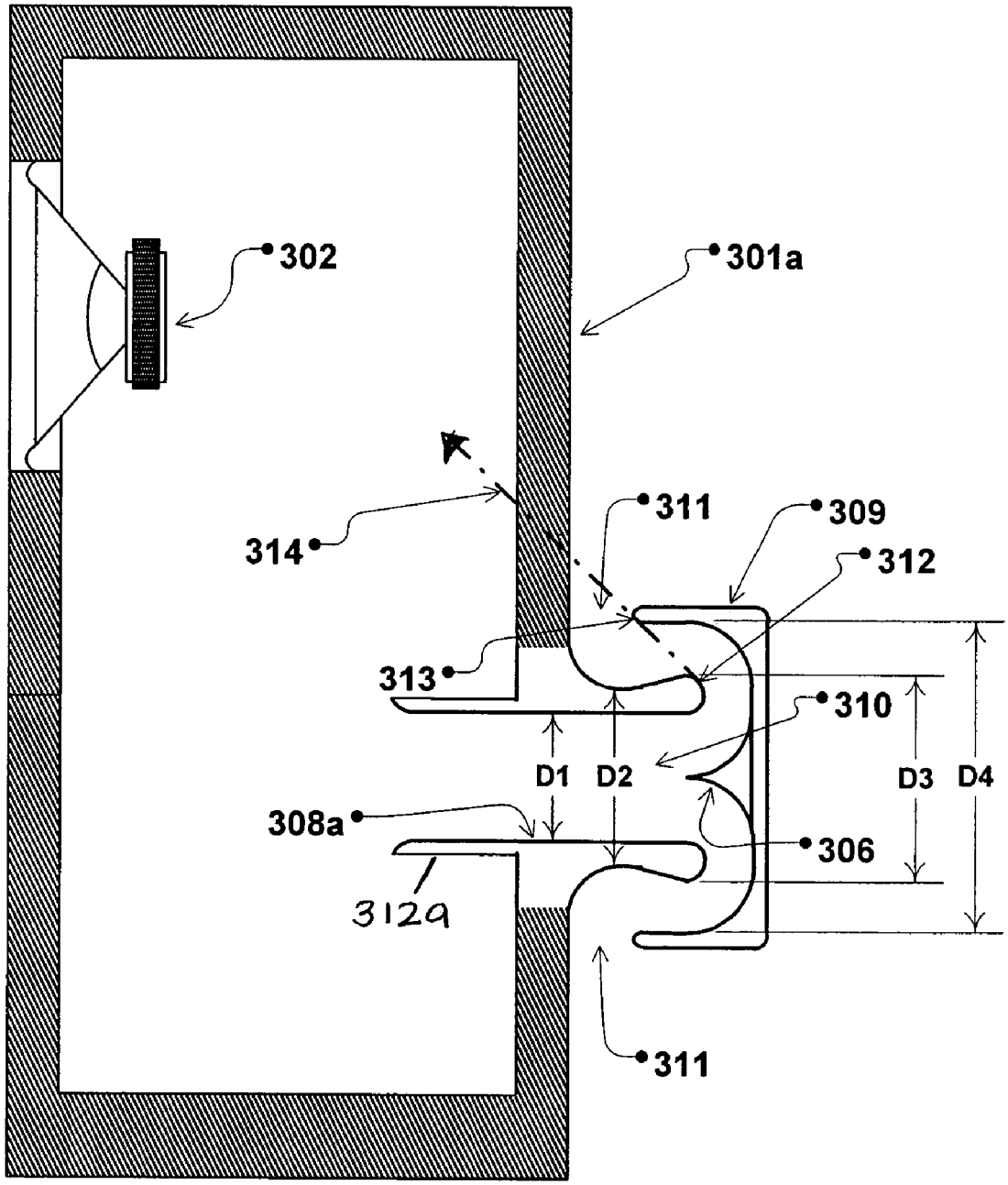

FIG. 3*b* illustrates a cross-sectional side view of a second embodiment of a loudspeaker having a weather resistant port according to the present invention.

Figure 4:
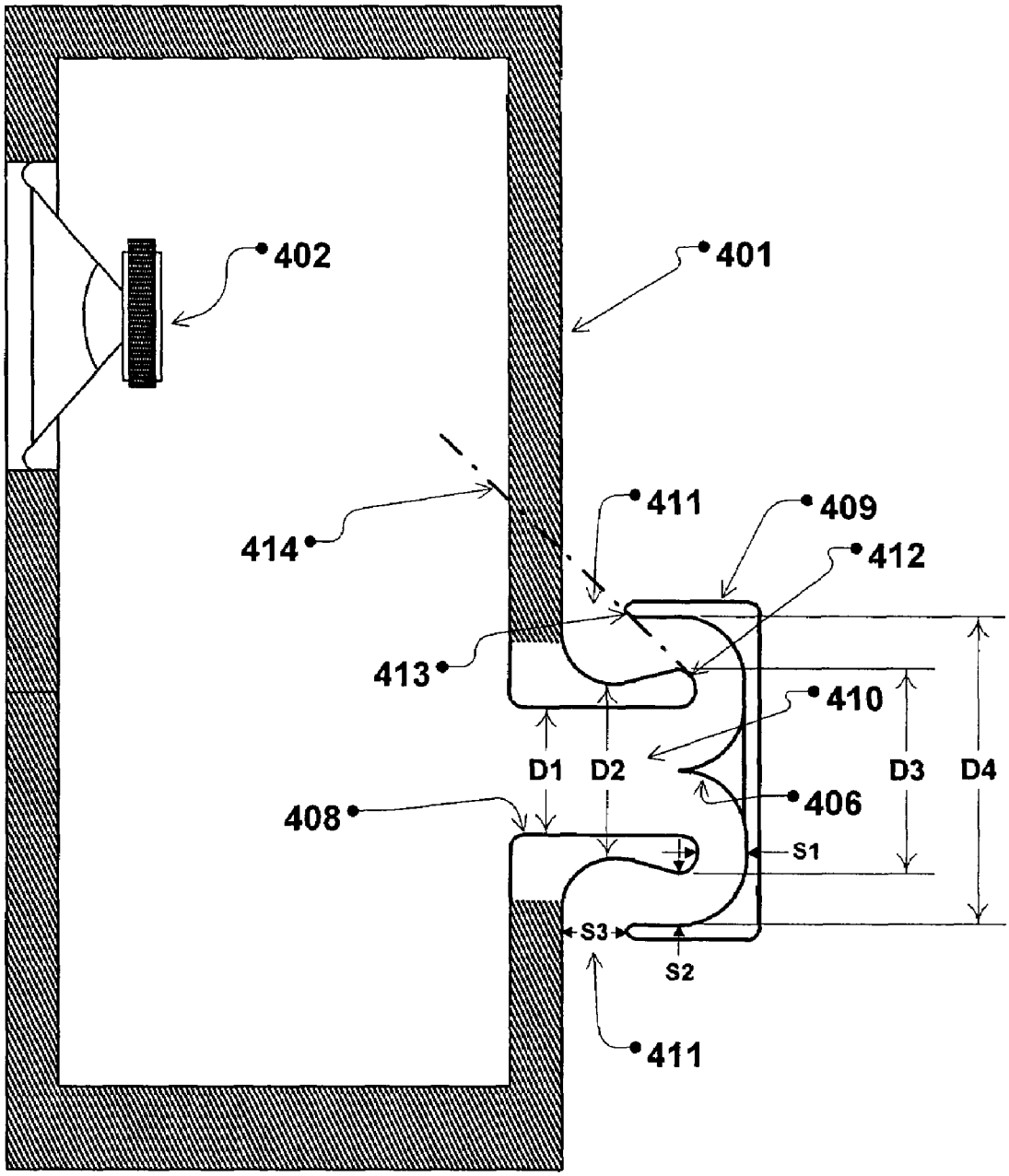

FIG. 4 illustrates a cross-sectional side view of a third embodiment of a loudspeaker having a weather resistant port according to the present invention.

Figure 5:
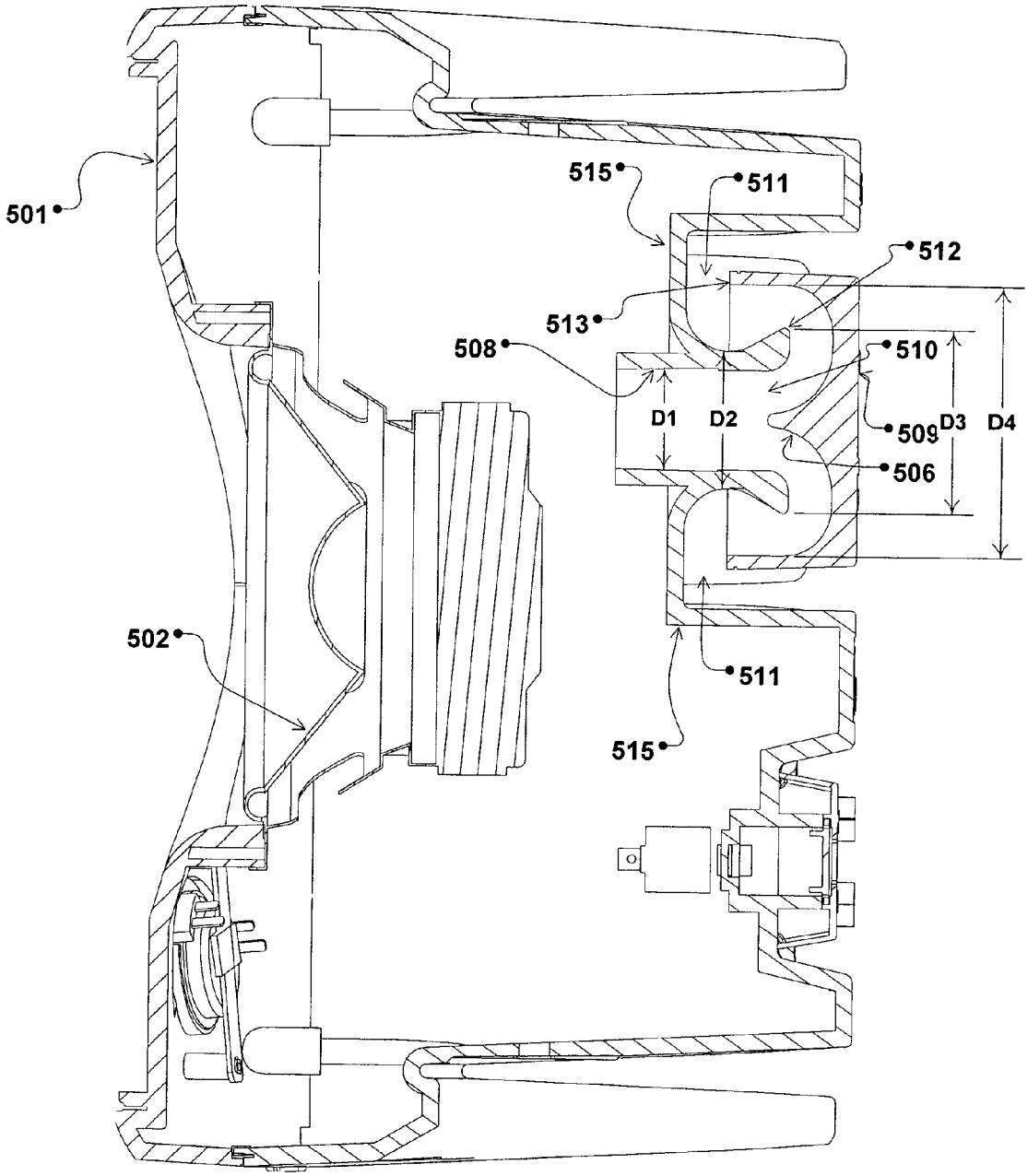

FIG. 5 illustrates a cross-sectional side view of a fourth embodiment of a loudspeaker having a weather resistant port according to the present invention.

Figure 6:
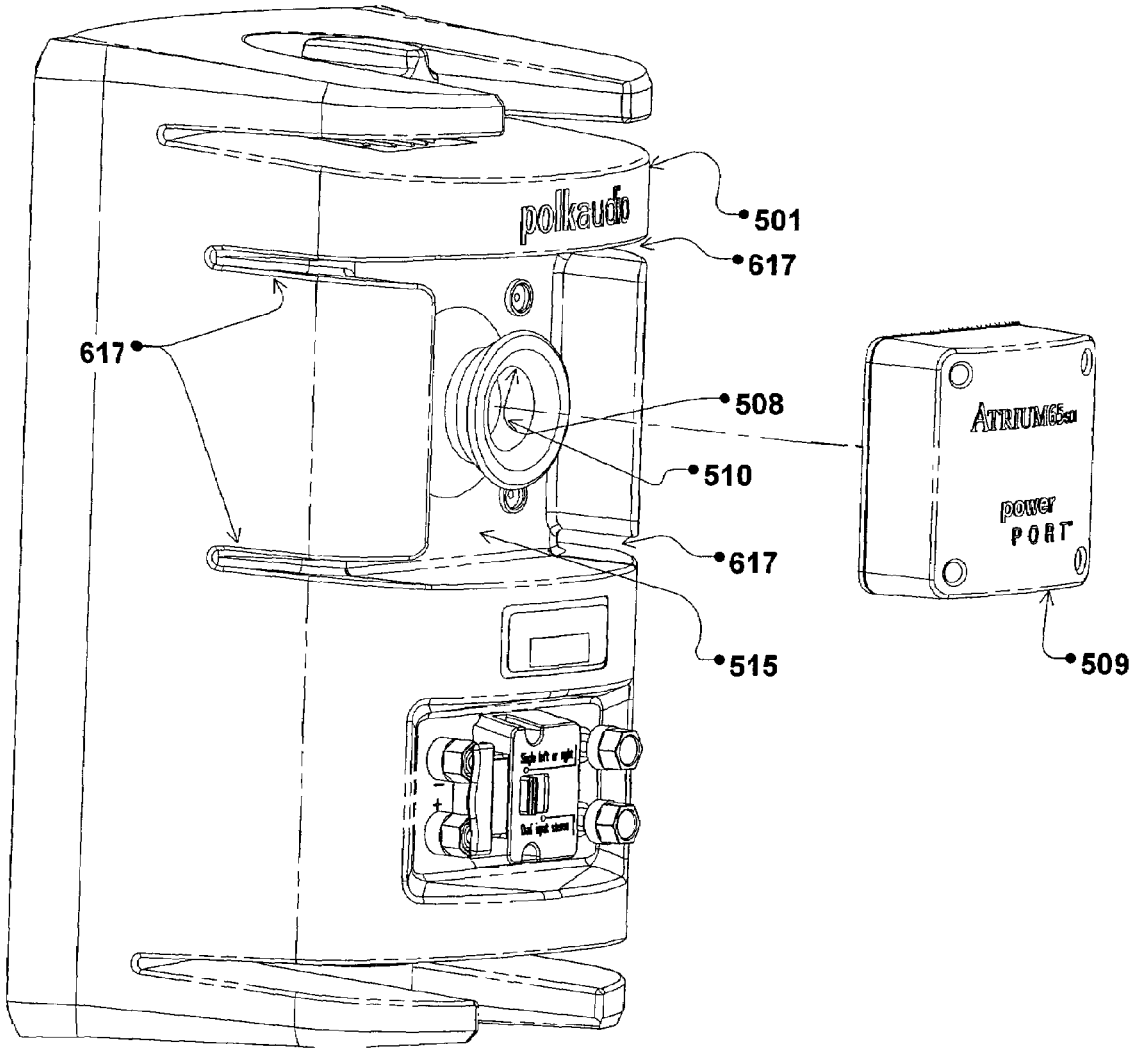

FIG. 6 illustrates a perspective, partially exploded view of the loudspeaker of FIG. 5.

Figure 7:
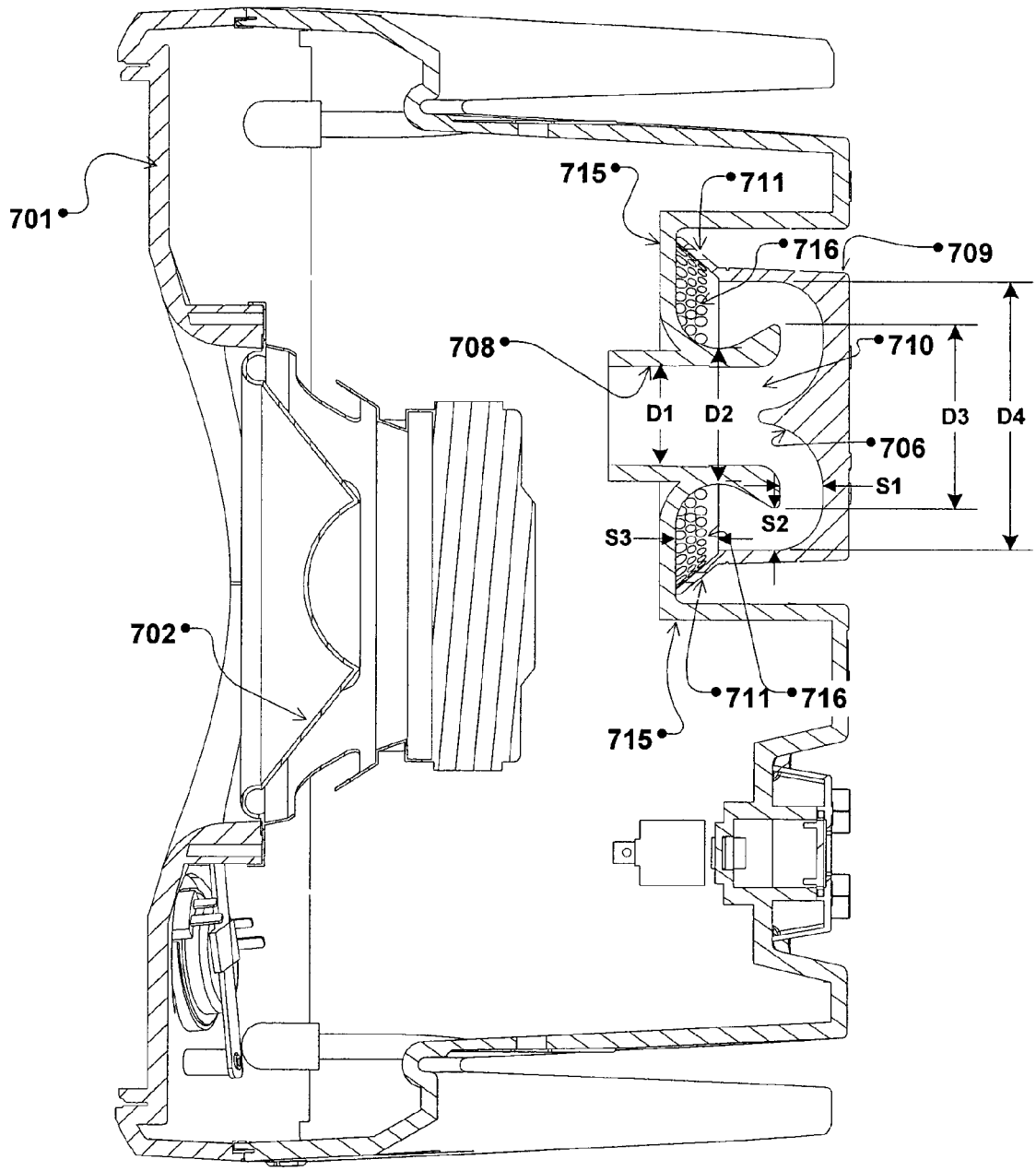

FIG. 7 illustrates a cross-sectional side view of a fifth embodiment of a loudspeaker having a weather resistant port according to the present invention.

Figure 8:
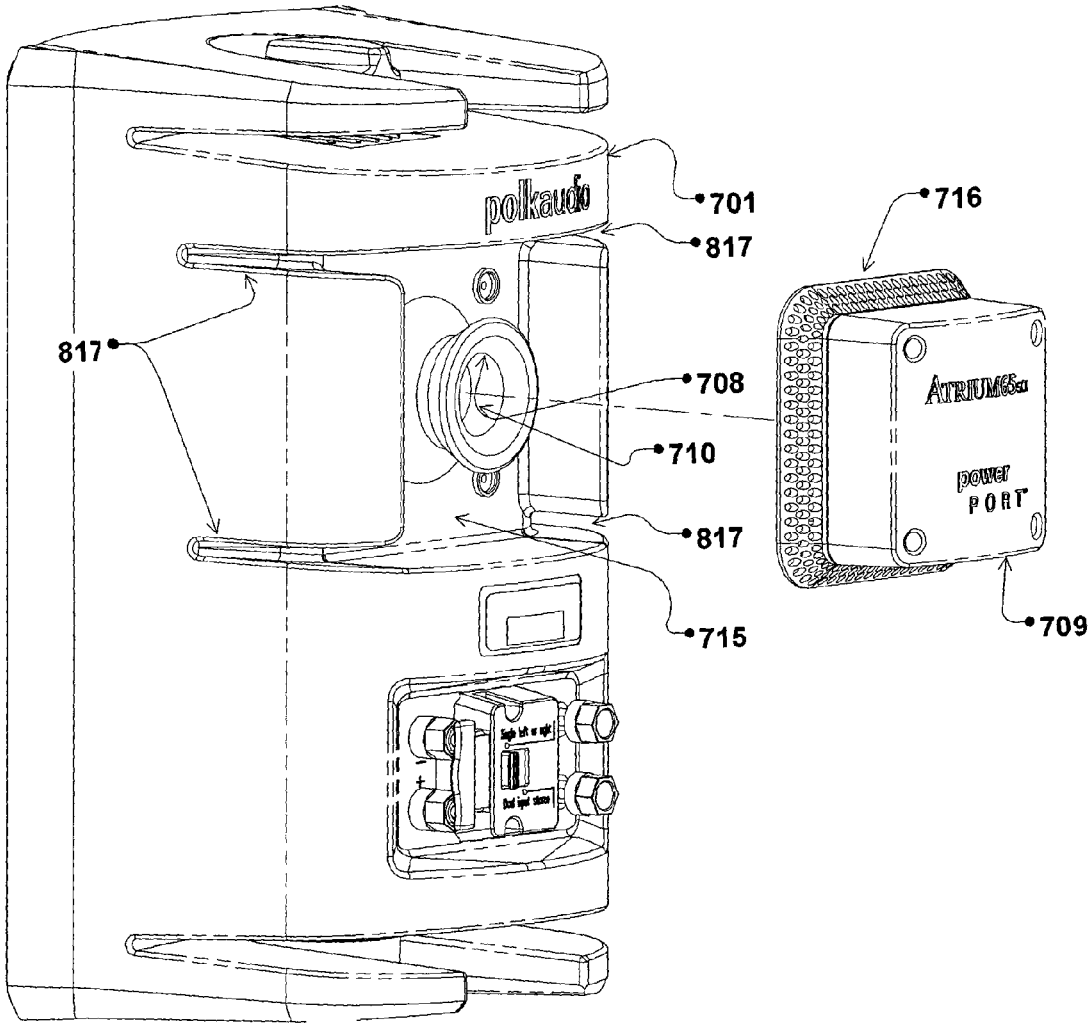

FIG. 8 illustrates a perspective, partially exploded view of the loudspeaker of FIG. 7.

DETAILED DESCRIPTION OF THE INVENTION

Figure 1:
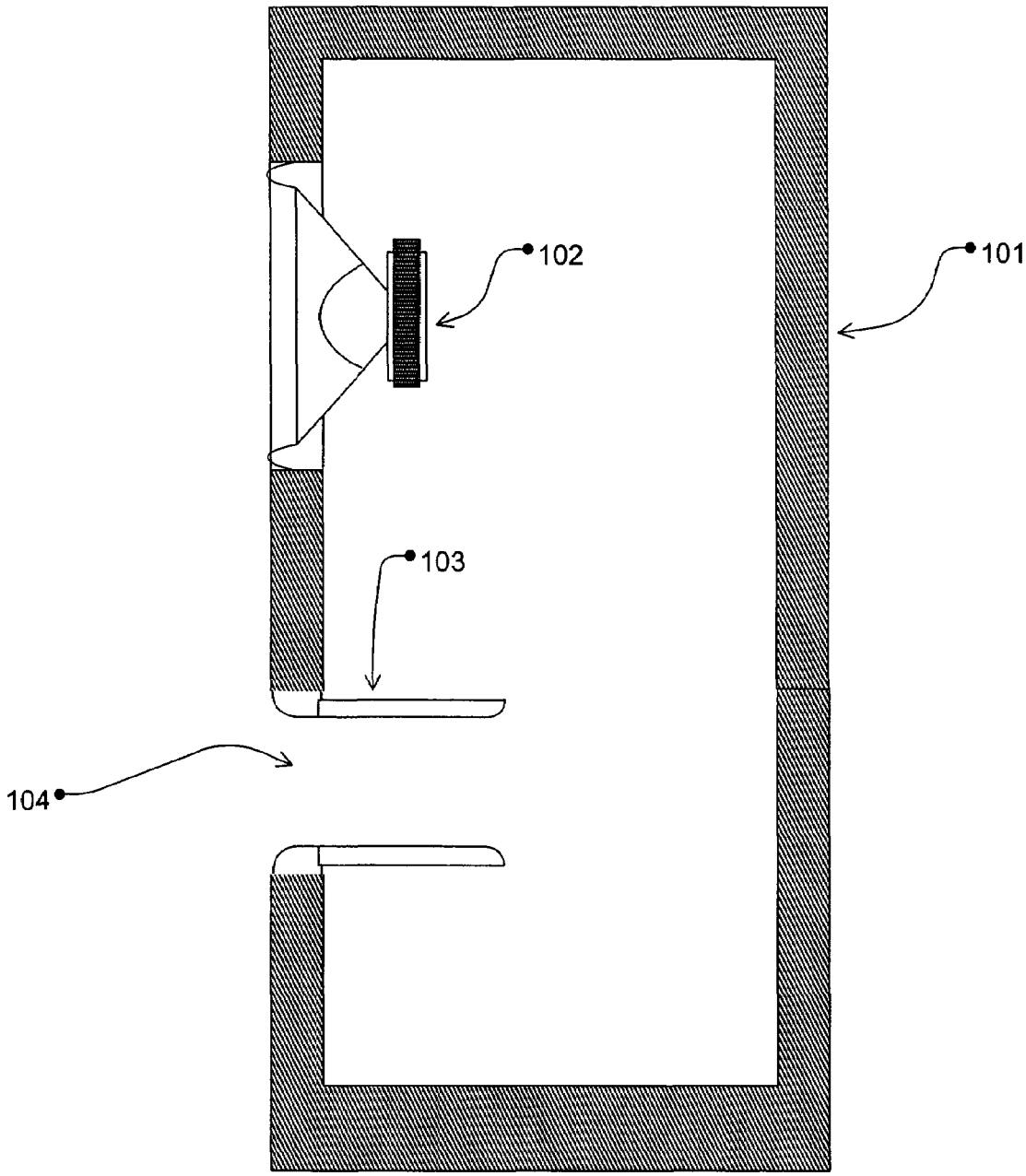
FIG. 1 illustrates a cross-sectional side view of a conventional ported loudspeaker.

FIG. 1 shows a conventional loudspeaker system incorporating an enclosure 101, a transducer 102, and a conventional port tube 103 having an exterior opening 104. The function of port tube 103 in tuning the low frequency response of the loudspeaker system to achieve greater efficiency in the reproduction of low frequencies is well understood by those skilled in the art. In general, a larger acoustic mass of air contained within port tube 103 contributes to a lower tuning frequency for the loudspeaker system. The acoustic mass of the air contained within port tube 103 is proportional to the length of port tube 103 and inversely proportional to the cross-sectional area of port tube 103. Therefore, as is well-known to those skilled in the art, a port tube of smaller diameter will have a greater acoustic mass than a port tube of larger diameter and having the same length. However, turbulence resulting from the air moving rapidly through port tubes such as port tube 103 can produce audible distortion in the form of "chuffing", and loss of efficiency at low frequency. As is also well-understood by those skilled in the art, port tubes such as port tube 103 having a smaller cross-sectional area generally produce audible distortion and loss at lower sound output levels than ports having a larger cross-sectional area. Therefore, while it is desirable to use a port tube with a smaller cross-sectional area to achieve a lower tuning frequency, a port tube having a larger cross-sectional area is desirable for achieving low frequency reproduction with high efficiency and low distortion.

Using a porting structure such as is shown in FIG. 1 would be inadvisable in outdoor applications due to the likelihood of water entering loudspeaker enclosure 101, through an exterior opening 104 and port tube 103 if the loudspeaker system were oriented with exterior opening 104 pointing even slightly upward. Also, debris, insects or other vermin may enter loudspeaker enclosure 101 regardless of orientation.

Figure 2:
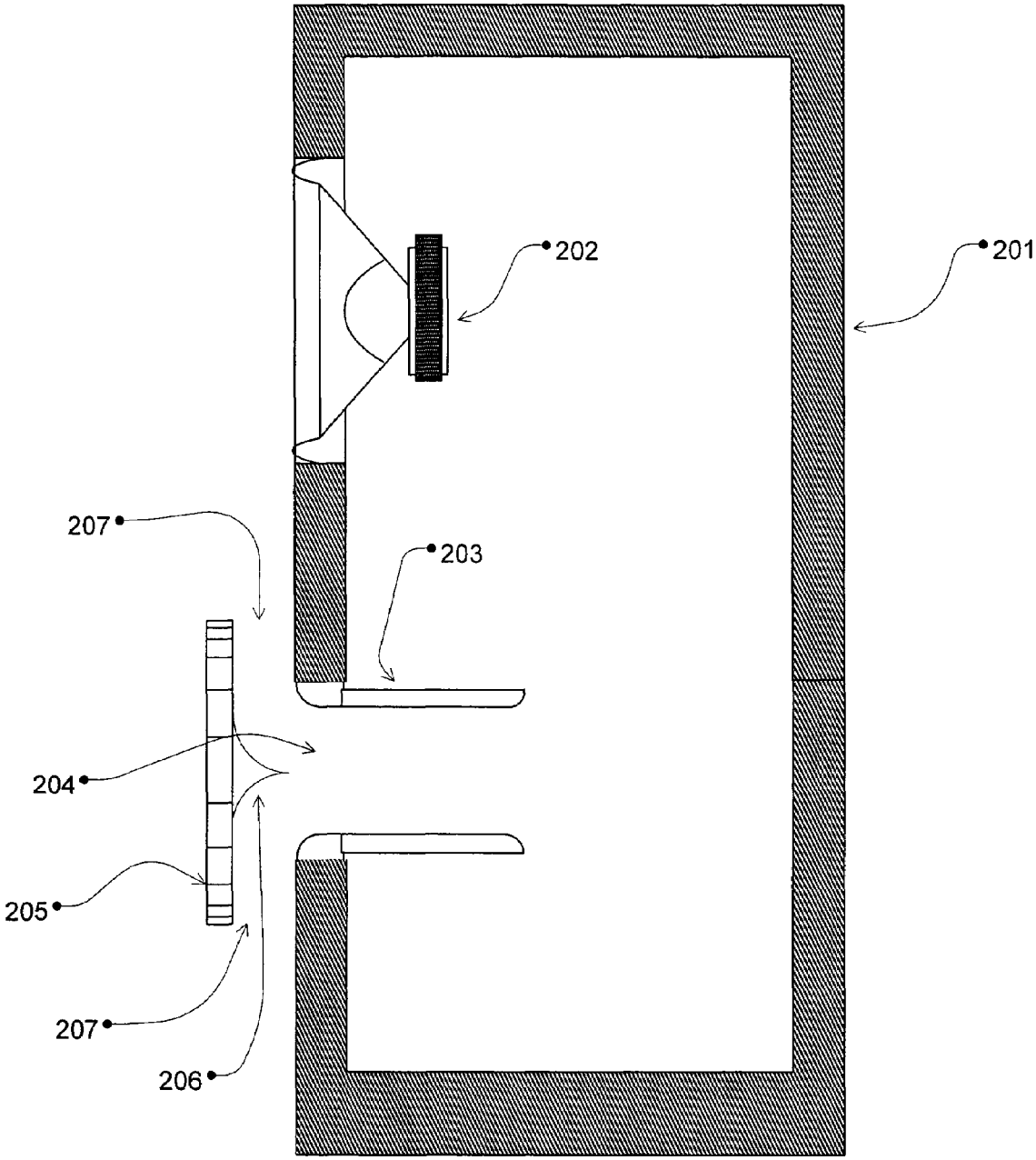
FIG. 2 illustrates a cross-sectional side view of a loudspeaker having a port with reduced turbulence.

FIG. 2 shows an improved porting method according to the teachings of U.S. Pat. Nos. 5,517,573 and 5,809,154, each of which are incorporated herein in their entirety by reference thereto. As shown in FIG. 2, an exterior opening 204 is blocked by a disk 205, thereby providing a port structure with an increasing cross-sectional area at the end outside of an enclosure 201 for the purpose of reducing turbulence and loss. A flow guide 206 is incorporated to further reduce turbulence and loss. However, in spite of disk 205 blocking exterior opening 204, this configuration is unacceptable for outdoor applications due to the likelihood of water entering the port structure through an exterior opening 207 around the perimeter of disk 205, thereby entering a loudspeaker enclosure 201 via a port tube 203 for any upward orientation of disk 205. As compared with the structure shown in FIG. 1, the potential for other detritus to enter enclosure 201 through the port structure is slightly reduced but still possible.

Referring to FIGS. 3 and 3*a*, a first embodiment of the present invention is shown. According to this first embodiment, a port tube 308 extends outwardly from an enclosure 301. A port tube opening 310 is covered by a port cover 309 which incorporates a flow guide 306 for reduced turbulence as disclosed in U.S. Pat. Nos. 5,517,573 and 5,809,154. Mounting bosses 309*a*, which are small compared to the perimeter of port cover 309 are used to support port cover 309. The dimensions of port cover 309 are chosen such that the total cross-sectional area of an exterior opening 311 around the perimeter of port cover 309 is significantly greater than the cross-sectional area of port tube opening 310. As is well understood by those skilled in the art a port structure with a large cross-sectional area at its outermost end serves to reduce turbulence and loss. The dimensions of port cover 309 are also chosen such that any straight line drawn directly from a tangent point on an outer end 312 of port tube 308 through a tangent point on a perimeter edge 313 of port cover 309 intersects some solid part of enclosure 301 as shown for the purposes of example by phantom dashed line 314. This serves to prevent rain from entering enclosure 301 from above by passing directly through exterior opening 311 and past outer end 312 of port tube 308 regardless of the mounting angle or orientation of the loudspeaker system and port structure. The dimensions of port tube 308 are chosen such that a first outside diameter D2 located towards the point where port tube 308 joins the wall of enclosure 301 is sufficiently smaller than a second outside diameter D3 located near outer end 312 of port tube 308 so as to permit water entering exterior opening 311 from above to drain around port tube 308 and out exterior opening 311 on the lower side without flowing over outer end 312 of port tube 308 into enclosure 301. This arrangement is effective for a difference between first outside diameter D2 and second outside diameter D3 as small as 8 mm.

Referring now to FIG. 3*b*, a second embodiment of the present invention is shown. A port tube 308*a* is of arbitrary length, and an end portion 312*a* may extend past an inner surface of an enclosure 301*a* into an interior thereof. Any commonly used end treatment, for example a flange or flare, may be used within the scope of this invention. This embodiment is identical in all other respects to the first embodiment, described above. Further, the teachings of this embodiment may be used with any other embodiment described herein.

Referring now to FIG. 4, a third embodiment of the present invention is shown which is similar to the first embodiment described above with respect to FIG. 3. According to this embodiment, the dimensions of a port cover 409 are further determined by a port tube diameter D1, a port cover diameter D4, and first, second and third port cover spacings S1, S2 and S3, respectively. In addition to the dimensional requirements described with respect to the first embodiment, in this embodiment first port cover spacing S1 is greater than or equal to one-fourth (¼) port tube diameter D1; second port cover spacing S2 is greater than or equal to first port cover spacing S1; and the third port cover spacing S3 is greater than or equal to one-half (½) port tube diameter D1. The resulting ratio of the cross-sectional area at exterior opening 411 to the cross-sectional area at port tube opening 410 is greater than three (3) when allowances are made for typical material thicknesses.

A fourth embodiment of the present invention is shown in FIG. 5. This embodiment is similar to the previous embodiments shown in FIGS. 3, 3*a*, 3*b* and 4. However, in an effort to make the loudspeaker system more compact and the port structure less subject to damage, the port structure has been recessed into a rear wall of an enclosure 501 by creating a recessed area 515. This allows a port cover 509 to be recessed flush with the rear wall of enclosure 501. However, with certain mounting orientations, recessed area 515 may fill with water ultimately allowing water to enter enclosure 501 or causing the port to function improperly. As such, four slots 617, shown in FIG. 6, provide a path for water entering recessed area 515 to drain away from the port structure.

A fifth embodiment of the present invention, similar to the fourth embodiment, described above, is shown in FIGS. 7 and 8. In order to prevent debris, insects and other vermin from entering loudspeaker enclosure 701, a screen 716 is added to the structure of the previous embodiment so as to completely cover an exterior opening 711 around the entire perimeter of a port cover 709. As mentioned previously, the high velocity of air moving through a conventional port makes the use of a screen impractical due the resulting turbulence and loss. However, one of the advantages of the present invention is the increase in cross-sectional area from a port tube opening 710 to exterior opening 711 where screen 716 is installed. When the dimensions of this embodiment are chosen in accordance with the requirements of the second embodiment, the resulting cross-sectional area at exterior opening 711 is more than three (3) times greater than the cross-sectional area at port tube opening 710, thereby reducing the velocity of air at exterior opening 711 and also reducing the amount of turbulence and loss resulting from the use of screen 716.

For the purposes of example only, the following approximate dimensions may be used for this embodiment:

| | |
|---|---|
| D1 = 28 mm | S1 = 14 mm |
| D2 = 41 mm | S2 = 17 mm |
| D3 = 56 mm | S3 = 14 mm |
| D4 = 90 mm | |

These dimensions yield a ratio of the cross-sectional area at exterior opening 711 to the cross-sectional area of port tube opening 710 of approximately 6.40. Also in this embodiment, screen 716 has an open area ratio of approximately 35% open to 65% closed.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents. All patents and publications discussed herein are incorporated in their entirety by reference thereto.

What is claimed is:

1. A loudspeaker system comprising:

a transducer;

an enclosure for housing said transducer; and a port disposed in said enclosure for tuning the low frequency performance of said loudspeaker system, said port comprising a port tube extending at least in part outside of said enclosure, said port tube having a predetermined internal cross-sectional area, a port cover for covering an outermost opening of said port tube, wherein said port cover is generally cup-shaped so as to fit over and overlap an outermost end of said port tube, wherein a first distance measured between an internal surface of said port cover and an exterior of said port tube is maintained therebetween to be at least approximately equal to one-half of the radius of the predetermined internal cross-section area of said port tube wherein a second distance measured between an edge of said port cover nearest to said enclosure and a wall of said enclosure is greater than the average radius of an average cross-sectional area of said port tube such that a total cross-sectional area of an opening created between said port cover and said enclosure is substantially greater than said predetermined internal cross-sectional area of said port tube, such that any line drawn directly from a tangent point on the outer-most end of said port tube through a tangent point on an edge of said port cover nearest to said enclosure intersects with a solid part of said loudspeaker system.

2. The loudspeaker system according to claim 1, wherein port tube has a first external cross-sectional area near the outermost end of said port tube and a second external cross-sectional area between said first external cross-sectional area and said enclosure such that said first external cross-sectional area is larger than said second external cross-sectional area.

3. The loudspeaker system according to claim 1, wherein the opening created between said port cover and said enclosure is covered by a screen such that an open area percentage of said screen multiplied by the result of the cross-sectional area of said opening between said port cover and said enclosure divided by the predetermined internal cross-sectional area of said port tube is greater than or equal to 1.67.

4. The loudspeaker system according to claim 3, wherein the screen has an open area greater than approximately 35% and a closed area less than approximately 65%, and the ratio of the cross-sectional area of said opening between said port cover and said enclosure divided by the predetermined internal cross-sectional area of said port tube is at least five.

5. A loudspeaker system comprising:

a transducer;

an enclosure for housing said transducer; and a port disposed in said enclosure for tuning the low frequency performance of said loudspeaker system, said port comprising a port tube extending at least in part outside of said enclosure, said port tube having a predetermined internal cross-sectional area, and a port cover for covering an outermost opening of said port tube, wherein said port cover is generally cup-shaped so as to fit over and overlap an outermost end of said port tube, wherein in a distance measured between an internal surface of said port cover and an exterior of said port tube is maintained therebetween to be at least approximately equal to one-half of the radius of the predetermined internal cross-section area of said port tube, a recessed area disposed in said enclosure for accepting said port tube and said port cover such that an outer surface of said port cover is generally flush with a surrounding surfaces of said enclosure; and drainage channels disposed in said recessed area such that water entering said recessed area drains away from said port tube.

6. The loudspeaker system according to claim 5, wherein an opening created between said port cover and said enclosure is covered by a screen such that an open area percentage of said screen multiplied by a result of the cross-sectional area of said opening between said port cover and said enclosure divided by the predetermined internal cross-sectional area of said port tube is greater than or equal to 1.67.

7. The loudspeaker system according to claim 6, wherein the screen has an open area greater than approximately 35% and a closed area less than approximately 65%, and the ratio of the cross-sectional area of said opening between said port cover and said enclosure divided by the predetermined internal cross-sectional of said port tube is at least five.

8. The loudspeaker system according to claim 5, wherein a second distance measured between an edge of said port cover nearest to said enclosure and a wall of said enclosure is greater than the average radius of an average cross-sectional area of said port tube such that a total cross-sectional area of an opening created between said port cover and said enclosure is substantially greater than said predetermined internal cross-sectional area of said port tube, such that any line drawn directly from a tangent point on an outermost end of said port tube through a tangent point on an edge of said port cover nearest to said enclosure intersects with a sold part of said loudspeaker system.

9. The loudspeaker system according to claim 5, wherein said port tube has a first external cross-sectional area near an outermost end of said port tube and a second external cross-sectional area between said first external cross-sectional area and said enclosure such that said first external cross-sectional area is larger than said second external cross-sectional area.

* * * * *